US005447402A

United States Patent [19]

Kobayashi

[11] Patent Number: 5,447,402

[45] Date of Patent: Sep. 5, 1995

[54] INSTRUMENT FOR BINDING PAPERS

[75] Inventor: Eizo Kobayashi, Tokyo, Japan

[73] Assignee: Sun-Star Stationery Corporation, Tokyo, Japan

[21] Appl. No.: 199,639

[22] Filed: Feb. 22, 1994

[30] Foreign Application Priority Data

Sep. 13, 1993 [JP] Japan ..... 5-054436 U

[51] Int. Cl.[6] ..... B42C 5/00; B31F 5/00

[52] U.S. Cl. ..... 412/33; 412/6; 493/351; 493/392

[58] Field of Search ..... 493/350, 351, 353, 390, 493/392; 412/6, 7, 33, 38; 83/861, 862

[56] References Cited

U.S. PATENT DOCUMENTS

| | | | |
|---|---|---|---|
| 1,487,079 | 3/1924 | Stillwagon | 493/351 |
| 1,490,437 | 4/1924 | Sparks | 493/351 |
| 2,083,538 | 6/1937 | Affelder | 40/310 |
| 3,793,928 | 2/1974 | Wootten . | |
| 3,923,575 | 12/1975 | Wooten | 493/351 X |
| 4,068,565 | 1/1978 | Olsen et al. . | |
| 5,024,643 | 6/1991 | Kastner | 493/351 |

FOREIGN PATENT DOCUMENTS

| | | |
|---|---|---|
| 699315 | 7/1930 | France . |
| 255303 | 4/1911 | Germany . |
| 56-500248 | 3/1981 | Japan . |
| WO80/01778 | 9/1980 | WIPO . |

*Primary Examiner*—Tom Hughes
*Attorney, Agent, or Firm*—Jacobson, Price, Holman & Stern

[57] ABSTRACT

A paper binding instrument for binding a sheaf of papers without the use of metal staples including punching edges and auxiliary punching edges. The punching edges can make small holes in a sheaf of paper continuing from punched foot parts of a small width and punched head parts of a large width. The punching edges push down head pieces which were the head parts through the sheaf of papers while leaving punched pieces corresponding to the foot parts. The auxiliary punching edges can make auxiliary small holes facing in different directions from the facing directions of the small holes that are formed with the punching edges.

6 Claims, 7 Drawing Sheets

INSTRUMENT FOR BINDING PAPERS

TECHNICAL FIELD OF THE INVENTION

The present invention relates to a paper binding instrument which binds piled papers into a single body.

PRIOR ART

Typical paper binding instruments are known as staplers which bind piled papers with metal staples. A novel stapler has recently appeared which can bind papers without using metal staples, as shown in FIGS. 7–11. This device comprises punching edges 7′ shown in FIG. 8. A sheaf of piled papers 23′ is folded at the corners as seen in FIG. 7, and the punching edges 7′ make small holes 3′ including punched foot parts 1′ of small width and punched head parts 2′ of large width formed at front ends of the head parts. The punching edges push down head pieces 6′ which were the head parts 2′ through the sheaf of papers, with punched pieces 4′ corresponding to the small holes 3′, while maintaining base parts of the foot pieces 5′ corresponding to the foot parts 1′. If the punching edges 7′ are, as shown in FIG. 9, pushed through the sheaf of the piled and folded papers 23′, the small holes 3′ are formed by the cutting of the punched pieces 4′ as seen in FIG. 7. If the foot parts 1′ of the small holes 3′ are engaged by the head pieces 6′ of the punched papers 4′ as if they were jaws thereof, the papers may be bound.

With respect to the stapler of FIGS. 7–10, the sheaf of papers 23′ are folded in the corner during hole formation, resulting in a bad external appearance. If the sheaf of papers were bound without folding, the punched papers 4′ of the upper layer would slide along the foot parts of the small holes 3′ as illustrated by an arrow in FIG. 11, which is undesirable. There thus remains the problem of paper sliding.

SUMMARY OF THE INVENTION

It is an object of the present invention to provide a new paper binding instrument which does not need the folding of the papers for proper binding.

For accomplishing the above mentioned object, the paper binding instrument according to the present invention includes a punching mechanism having punching edges and auxiliary punching edges. The punching edges can make small holes including punched foot parts of small or narrow width and punched head parts of large width formed at the front ends of the head parts. The punching edges push down head pieces, which were the head parts, through the sheaf of papers with punched pieces corresponding to the small holes and maintaining hinged base parts of the foot pieces corresponding to the foot parts. The auxiliary punching edges can make auxiliary small holes facing in different directions from the facing directions of the small holes that are formed with the punching edges. The auxiliary punching edges push down the front end parts of the auxiliary small holes to form three-sided tabs that are hinged at one edge, thus preventing paper sliding.

The sheaf of papers are bound by catching the jaws of the head pieces of the punched papers in the foot parts of the small holes. The papers are prevented from sliding, so that the end parts, or corners, of the sheaf of papers do not require folding.

Figure 1:
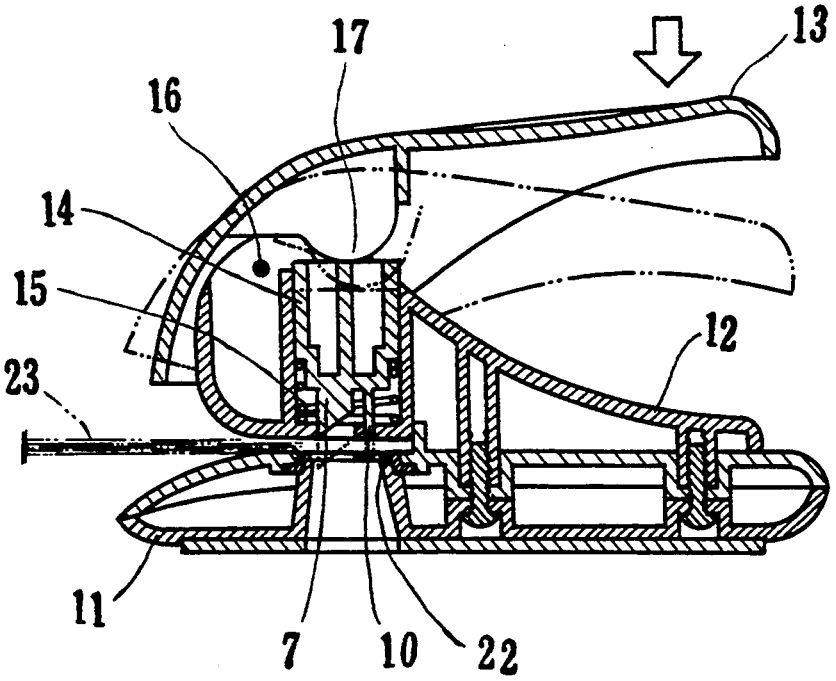
FIG. 1 is a cross sectional view of an entire body of the binding instrument.

In the drawings of FIGS. 1 through 6, the following numerals of the drawings are defined—1: foot part, 2: head part, 4: punched paper, 5: foot piece, 6: head piece, 7: punching edge, 8: auxiliary small hole, 9: auxiliary punched piece, 10: auxiliary punching edge, 14: punching metal, 15: spring, 16: axis, 17: projecting part, 18: foot of a narrow and lengthy part, 19: head of a large width.

PREFERRED EMBODIMENT OF THE INVENTION

An explanation will be made of the preferred embodiment with reference to the attached drawings.

The paper binding instrument of the invention is, as seen in FIG. 1, mainly composed of a base plate 11, a punching holder 12, a handle 13, a punching metal die 14, and a spring 15. The punching metal die 14 is attached to the punching holder 12 in a vertically movable manner and is biased upward by a spring 15. The handle 13 is rotatably mounted on the punching holder 12 around an axis 16, and a projecting part 17 is provided at the inside of the handle 13 to contact the top of the punching metal die 14.

Figure 2:
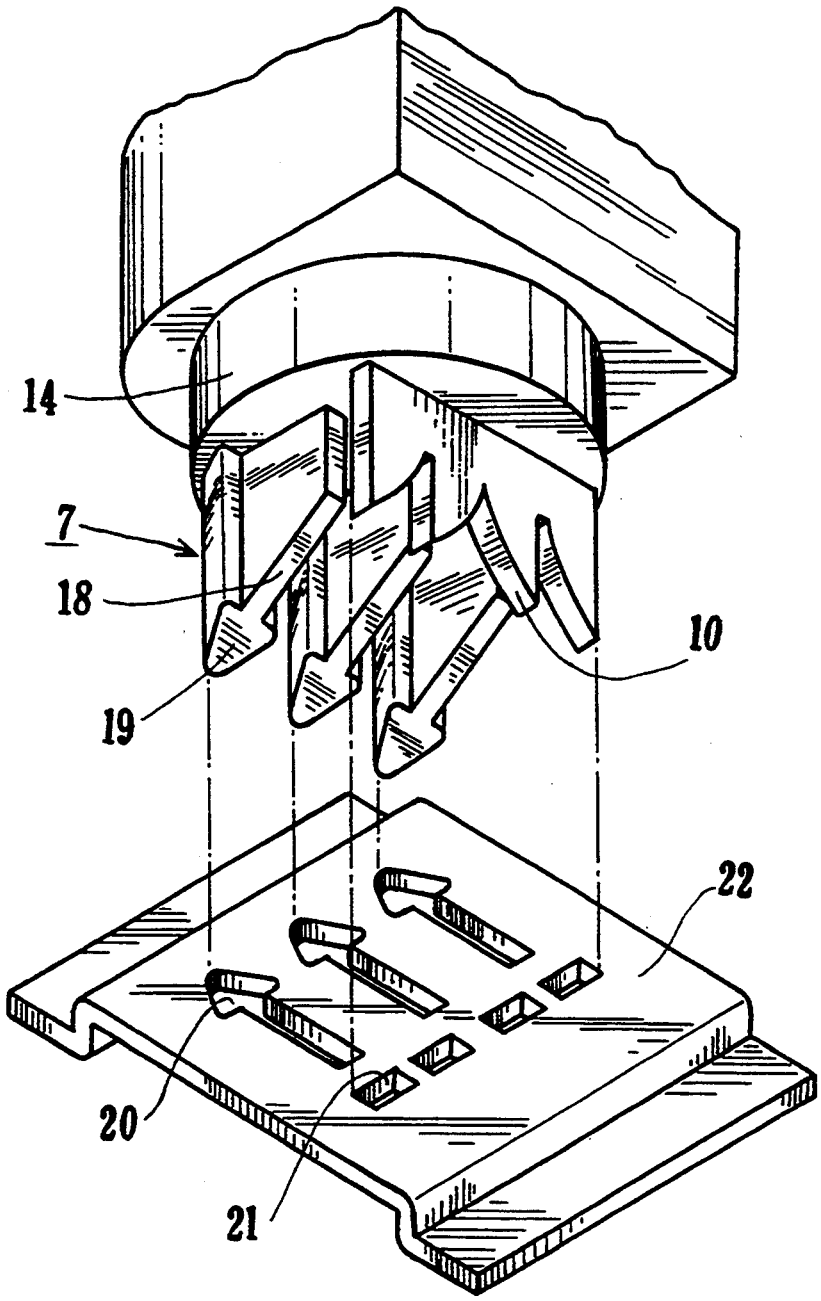
FIG. 2 is a perspective view of the lower end part of the punching element and a receiving part therefor.

As shown in FIG. 2, there are three rows of punching edges 7 on the lower end of the punching metal die 14, and four auxiliary punching edges or cutting heads 10 facing in different directions with respect to the punching edges 7 for preventing the papers from sliding. The punching edge 7 comprises a foot 18 of a narrow and lengthy part and a head 19 of a large width as shaped in an arrow in cross section, in which one side of the head 19 obliquely slants upward. The auxiliary punching edge 10 has a triangle shape at its lower end. A base plate 11 is positioned just under the punching metal die 14, and a receipt template 22 is furnished on the base plate 11 and is formed with holes 20, 21 for passing the punching edges 7 and the auxiliary punching edges 10 therethrough.

Figure 3:
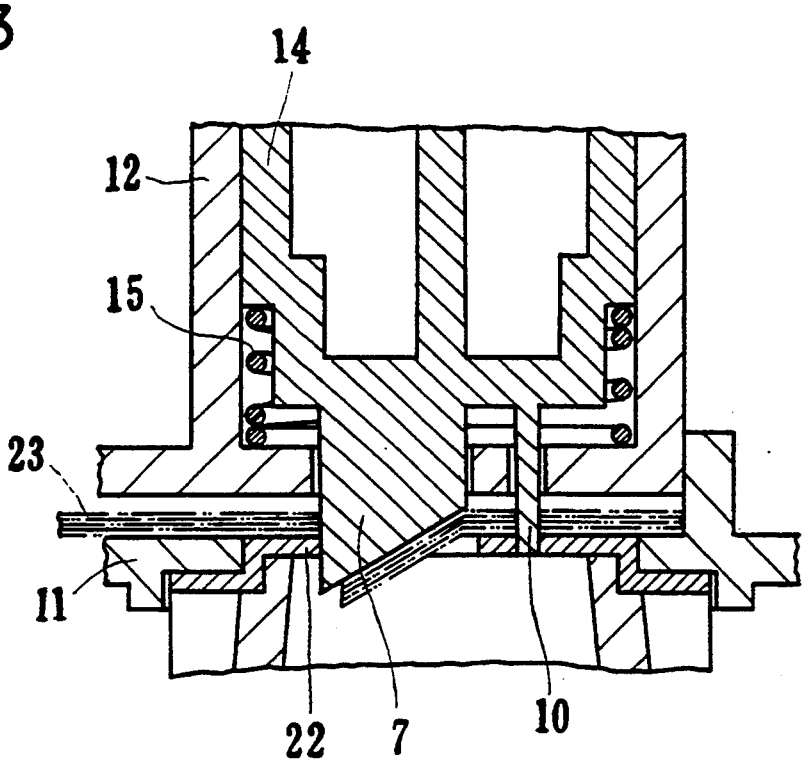
FIG. 3 is a cross sectional view of an element portion showing the making of small holes with the punching edges.
Figure 4:
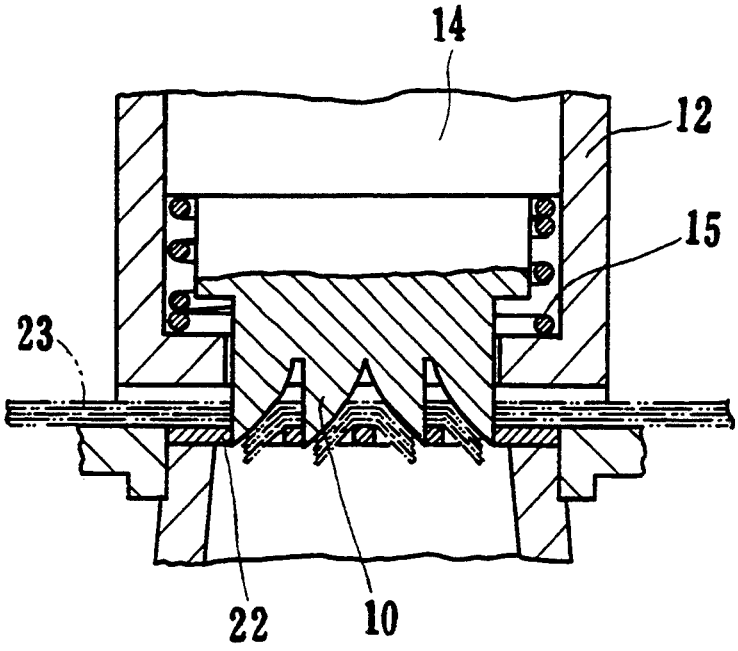
FIG. 4 is a cross sectional view of an element portion showing making of auxiliary small holes with the auxiliary punching edges.
Figure 5:
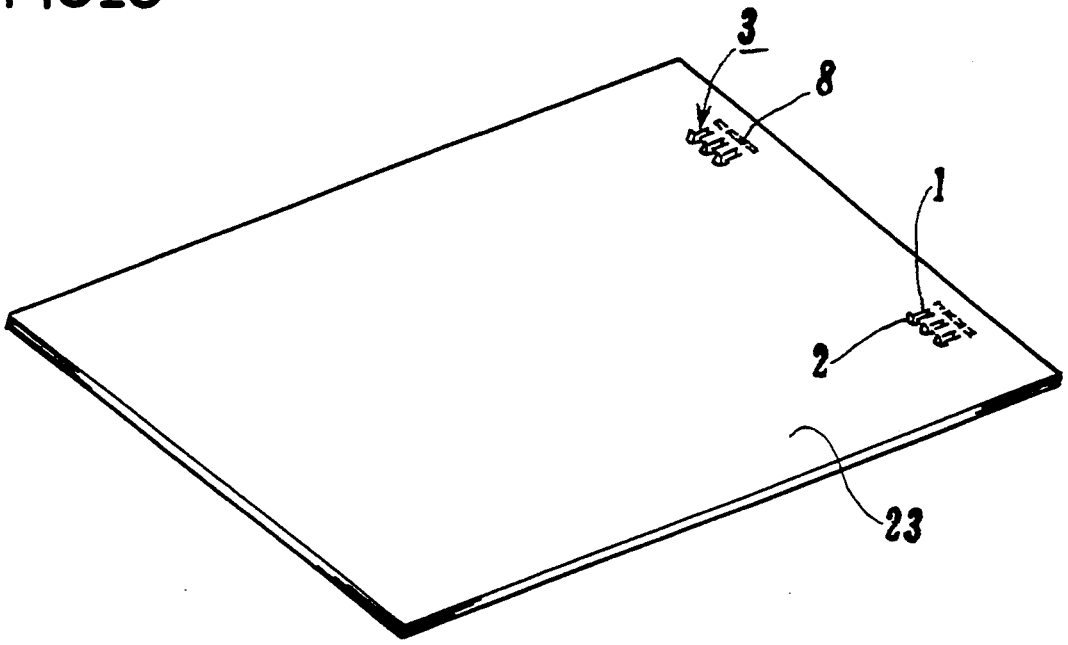
FIG. 5 is a perspective view showing a sheaf of bound papers.
Figure 6:
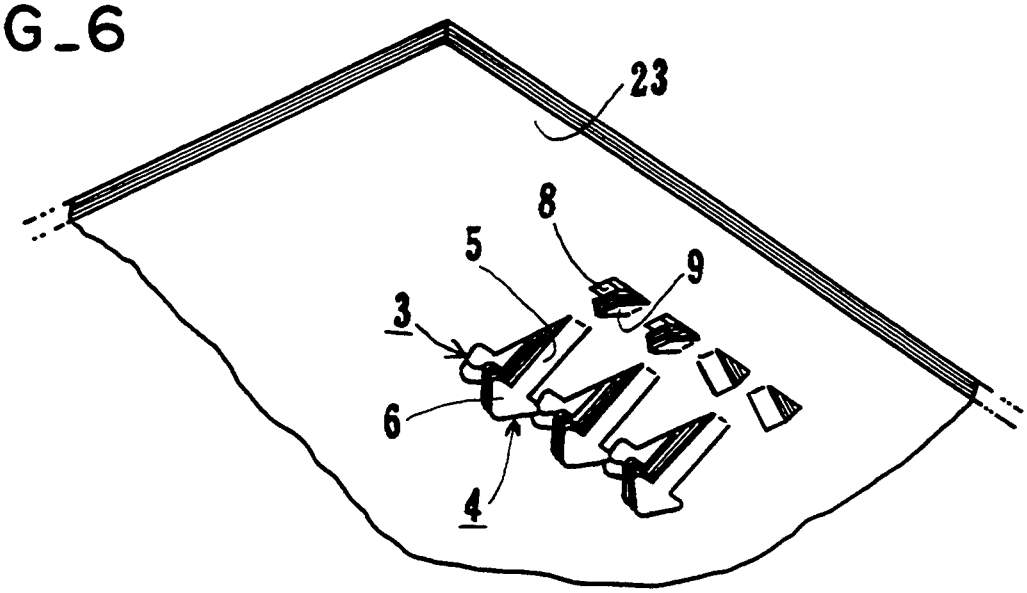
FIG. 6 is a perspective view of a partially enlarged part of a lower surface on a sheaf of bound papers.
Figure 7:
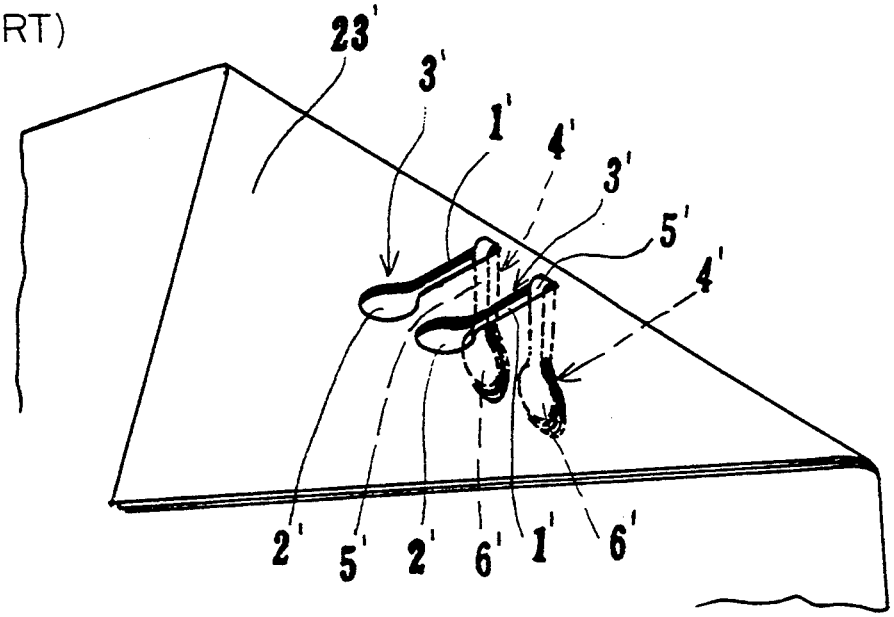
FIG 7 (PRIOR ART)
FIG. 7 is a perspective view showing the binding of a sheaf of papers by the prior art stapler.
Figure 8:
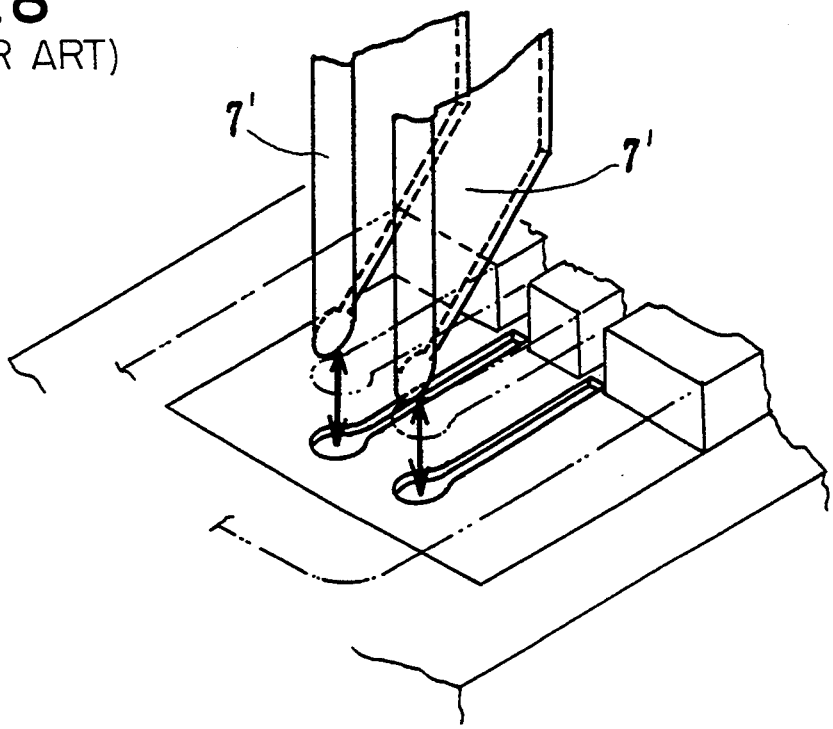
FIG 8 (PRIOR ART)
FIG. 8 is a perspective view showing the structure of the punching edge of the prior art stapler.
Figure 9:
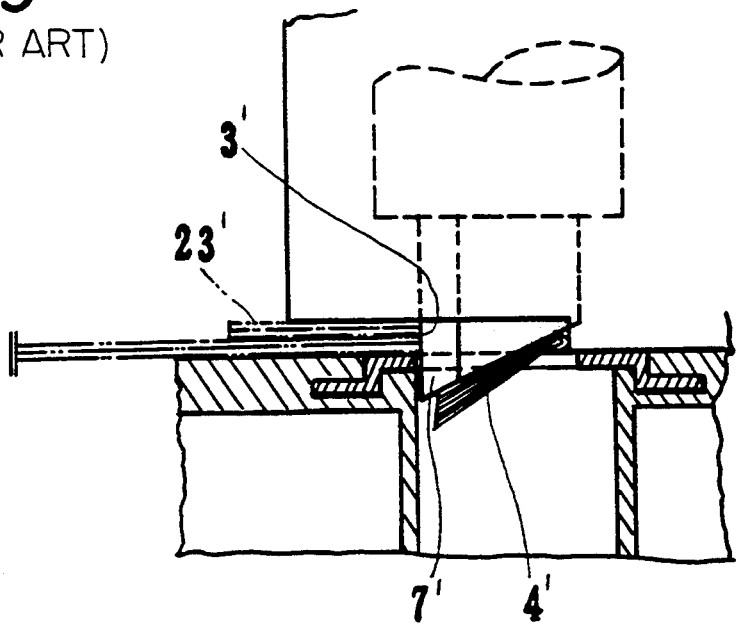
FIG 9 (PRIOR ART)
FIG. 9 is an explanatory view showing the making of a hole in a sheaf of papers by the prior art stapler.
Figure 10:
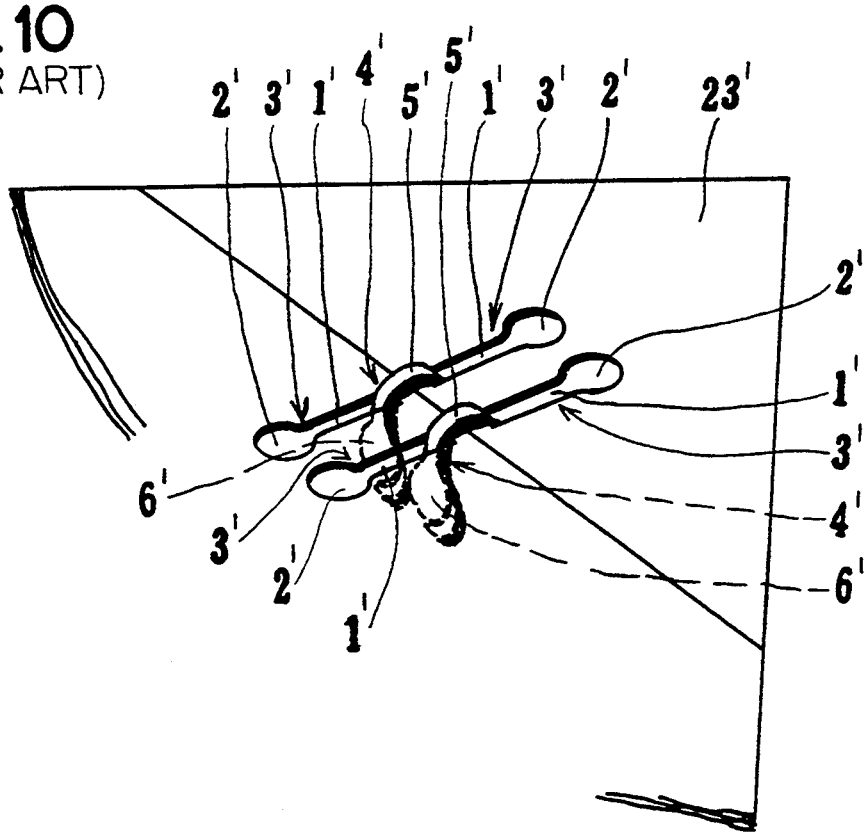
FIG 10 (PRIOR ART)
FIG. 10 is another perspective view showing the making of a hole in a sheaf of papers with the prior art stapler.
Figure 11:
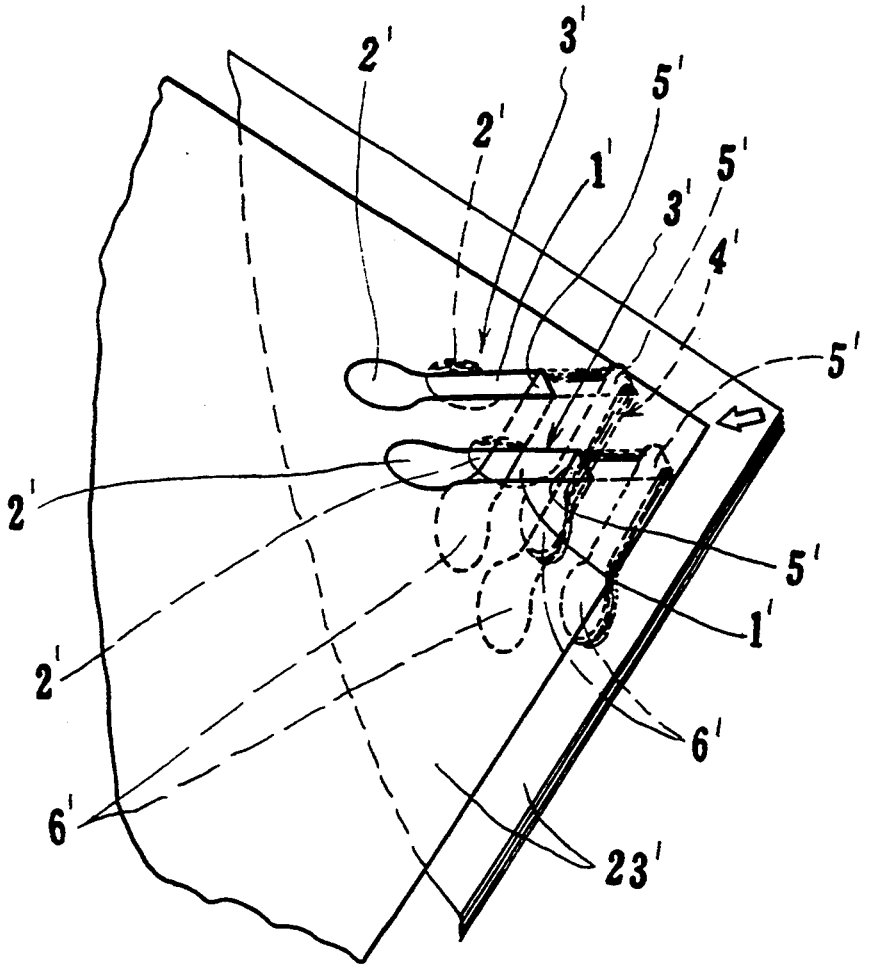
FIG 11 (PRIOR ART)
FIG. 11 is a perspective view showing the sliding of the papers to be bound with the prior art stapler, if the papers are not folded.

A plurality of the papers 23 are put on the receipt template 22 of the base plate 11, and if the handle 13 is pushed down on the front end in the direction of the arrow seen in FIG. 1, the projecting part 17 of the handle 13 pushes down the punching metal die 14 due to a fulcrum action, and the punching edges 7 and the auxiliary punching edges 10 punch out the sheaf of papers as illustrated in FIGS. 3 and 4. Thus, the papers 23 are formed with the punched holes 3 and auxiliary punched holes 8 as seen in FIGS. 5 and 6. The hole 3 comprises a foot part 1 of small width formed by the foot 18 of the punching edge 7 and the head part 2 formed by the head 19 continuing from the foot part 1, and this is shaped almost as an arrow. The auxiliary hole 8 punched out by the auxiliary punching edge 10 is rectangular. Since the punching edge 7 and the auxiliary punching edge 10 slant in the lower end faces and when those edges punch the piled papers, they do not completely cut out the punched papers 4 corresponding to the holes 3 and the auxiliary punched papers 9 corresponding to the auxiliary holes 8, but keep the connecting condition at one end thereof. In other words, the punched paper 4 comprises the foot piece 5 which was the foot part 1 and the head piece 6 which was the head part 2, and the foot piece 5 maintains the connection, i.e. is hinged, at its base portion. In addition, the punching edge 7 and the auxiliary punching edge 10 slant in the under end faces, whereby the head piece 6 of the front end of the punched paper 4 and one end of the auxiliary punched piece 9 are pushed down through the lower surface of the sheaf of papers 23. Since the punched papers 4 are moved so that the head pieces slightly slide toward the foot pieces of the small holes 3, the jaw of the head pieces 6 of the upper papers catch the edges of the foot parts 1 of the lower papers. Thus, the upper and lower papers do not separate from each other. Then, if the foot piece 5 and the head pieces 6 move, the upper and lower papers may tend to slide along the length of the foot parts. However, in the present invention, the auxiliary holes 8 are made facing in a different direction with respect to the small holes 3, and the auxiliary punched papers 9 are supported in the auxiliary small holes 8, so that sliding as stated above is prevented.

Thus, the present invention is safe in binding papers without using metal staples as in conventional staplers. Further, since the invention does not fold papers at the corner to be bound as in the prior art discussed above, a good external appearance is provided with prevention of paper sliding.

What is claimed is:

1. An instrument for binding a plurality of paper sheets, said instrument comprising:

a base plate, a template mounted on said base plate, a punching holder, and a punching die reciprocatingly mounted on said punching holder, said punching die including first and second punching pieces shaped complementary to openings of said template and extending transverse to each other for forming transversely extending punched paper pieces from said plurality of paper sheets when said punching die is moved towards said template, wherein said first punching piece is shaped to form first punched paper pieces from said plurality of sheets, each first punched paper piece having an elongated narrow foot portion that remains attached to the paper sheet at one end of the foot portion and having a wider head portion at the opposite end of the foot portion, and wherein said second punching piece is shaped to form second punched paper pieces from said plurality of sheets, each second punched paper piece substantially rectangular shaped and remaining attached to the paper sheet at one side edge of the rectangle, whereby said first and second punched paper pieces are disposed to extend through the bottom surface of said plurality of paper sheets in directions substantially transverse to each other.

2. An instrument for binding papers as claimed in claim 1, wherein said first punching piece is in a shape of an arrow with an elongated portion that forms the narrow foot portion and a triangular portion that forms the wider head portion.

3. An instrument for binding papers as claimed in claim 1, further comprising a handle pivotally mounted to said punching holder for engaging and moving said punching die.

4. An instrument for binding papers as claimed in claim 1 wherein said punching die includes a plurality of said first and second punching pieces.

5. An instrument for binding papers as claimed in claim 1 wherein said first punched paper piece does not extend through any opening formed from said second punched paper piece.

6. An instrument for binding papers, said instrument comprising:

a base plate, a template mounted on said base plate, a punching holder, and a punching die reciprocatingly mounted on said punching holder, said punching die including two punching pieces shaped complementary to openings of said template and extending transverse to each other for forming transversely extending punched openings in a sheaf of paper when said punching die is moved towards said template, wherein one of said two punching pieces includes four cutting heads for cutting two rectangular-shaped openings by two of said cutting heads in a sheaf of paper from paper tabs punched by said two cutting heads anchored along one edge and extending in a direction opposite to paper tabs punched by the other two cutting heads anchored along one edge of two other rectangular-shaped openings in the sheaf of paper.

* * * * *